US005741010A

United States Patent [19]

Weyna

[11] Patent Number: 5,741,010

[45] Date of Patent: Apr. 21, 1998

[54] TRAP DOOR PROVIDING FOR INTERLEVEL BALL TRAVEL FOR PINBALL GAME

[76] Inventor: Mark Weyna, 345 S. Warrington Rd., Des Plaines, Ill. 60016

[21] Appl. No.: 771,172

[22] Filed: Dec. 20, 1996

[51] Int. Cl.[6] ..... A63F 7/30

[52] U.S. Cl. ..... 273/119 A; 273/121 A; 273/118 A; 273/129 S

[58] Field of Search ..... 273/118, 119, 273/121, 127 R, 129 R, 129 S, 129 T

[56] References Cited

U.S. PATENT DOCUMENTS

| | | | |
|---|---|---|---|
| 2,101,354 | 12/1937 | Williams | 273/118 A |
| 4,606,545 | 8/1986 | Ritchie | 273/121 A |
| 5,002,279 | 3/1991 | Kaminkow et al. | 273/119 A |
| 5,350,174 | 9/1994 | Ritchie et al. . | |
| 5,516,103 | 5/1996 | Lawlor et al. . | |
| 5,524,887 | 6/1996 | Trudeau et al. | 273/118 A X |

*Primary Examiner*—Raleigh W. Chiu
*Attorney, Agent, or Firm*—Rudnick & Wolfe

[57] ABSTRACT

An apparatus provides interlevel play for a pinball game having an inclined playfield. The apparatus includes an elevated surface mounted above the playfield for supporting a rolling ball thereon. The elevated surface has an aperture therein for receiving the rolling ball therethrough, and a trap door is movable between a closed position and an open position. In the closed position, the trap door extends substantially the length of the aperture to support the rolling ball thereon. In the open position, the rolling ball is allowed to be ejected through the aperture and onto the elevated surface. An ejecting mechanism is also provided for ejecting the rolling ball from underneath the elevated surface, through the aperture, and onto the elevated surface.

26 Claims, 4 Drawing Sheets

TRAP DOOR PROVIDING FOR INTERLEVEL BALL TRAVEL FOR PINBALL GAME

BACKGROUND OF THE INVENTION

The present invention relates generally to pinball games, and more particularly, to a play feature providing for interlevel rolling ball travel.

Rolling ball games, including pinball games, typically include an inclined playfield housed within a game cabinet and having mounted thereon a number of playfield features such as bumpers, tracks, targets, slots and the like. The playfield features influence the motion of the game ball, which is projected towards the features by flippers that are controlled by the game player. Pinball games appeal to players because of the novel arrangement of game features that make the game challenging and exciting to play. Generally, increased interaction between the player and the game means increased appeal. As players become more skilled at a particular game, however, the game loses its challenge and appeal. In order to maintain player interest and to satisfy the needs of the pinball game markets, novel game features and arrangements are constantly required.

Some pinball games are equipped with elevated play features, including, for example, elevated tracks and/or smaller playfields elevated above the main playfield. Access is sometimes provided by configuring these elevated features with inclined ramps to lift the ball from the main playfield to the elevated track or smaller playfield. Often, a player must activate a combination of features to allow the game ball access to the elevated feature. Such arrangements tend to require elaborate mechanical features or intricate ramp elements and are, therefore, somewhat costly and complex to manufacture. Moreover, the time required for the ball to reach the elevated feature can be excessive if the ball must travel the length of an inclined ramp. This delay slows play of the game and creates short periods of "dead time" when play of the game is temporarily suspended. In addition, devices for elevating the ball often occupy a relatively large portion of the playfield or at least hide a portion of it from the player's view, thereby limiting the number of other features that may be incorporated on the playfield or reducing the player's ability to track the game ball as it rolls from the lower to the upper play feature.

Another common play feature is a ball popper, which typically includes a recess or eject hole for trapping the game ball on or below the playfield for a period of time until an ejection device pushes the ball back onto the playfield. Ejection of the ball from the recess is usually accomplished by a solenoid activated plunger mechanism. In existing pinball games, balls are loaded into position for engagement with the ejection device in two ways. One way is to use a ramp or other guidance device mounted on or above the playfield to guide the ball into the desired location. Alternatively, a ball delivery system is located below the playfield, out of the player's view, usually consisting of a ramp or ramps leading from a ball inlet to the desired location.

It is therefore desirable to provide an elevated play feature and a device for rapidly and simply propelling a rolling ball from a lower playfield onto the elevated play feature.

SUMMARY OF THE INVENTION

In view of the above, and in accordance with the present invention, there is provided an apparatus for interlevel play in connection with a pinball game having an inclined playfield. The apparatus includes an elevated surface mounted above the playfield for supporting a rolling ball thereon. An aperture is formed in the elevated surface for receiving the rolling ball therethrough, and a trap door is provided for allowing the ball to enter the aperture. The trap door is movable between a closed position and an open position. In the closed position, the trap door extends substantially the length of the aperture to support the rolling ball thereon. This provides a stand-alone elevated play feature which allows continuous active play as a ball rolls over the trap door and continues rolling on the elevated surface. In the open position, another rolling ball is allowed to be ejected through the aperture and onto said elevated surface, thereby placing two balls into play, although the same ball that travels over the trap door can be ejected through the aperture if enough time elapses for the ball to reach an ejecting mechanism. The ejecting mechanism is provided for ejecting the rolling ball from underneath the elevated surface, through the aperture, and onto the elevated surface.

In a preferred embodiment of the invention, the elevated surface is configured as a track having a floor for delivering the rolling ball to a desired location. The trap door is hingedly attached to a support member and is pivotable about a horizontal pivot axis. Preferably, the pivot axis is positioned beneath the track and a terminal end portion of the trap door is adapted to extend through the aperture and rest against a top surface of the track floor. Thus, a substantially continuous support is provided for a rolling ball to move thereover. Preferably, the trap door is pivotable upwardly by contact with the rolling ball when the rolling ball is ejected from the ejecting mechanism. To limit the upward movement of the trap door, a stop member is disposed on the trap door. This causes the rolling ball to change direction when it is propelled through the aperture in the track, and also guides the rolling ball onto the top surface of the track.

Also preferably, the ejecting mechanism is configured as a conventional ball popper positioned beneath a hole in the inclined playfield. The hole is in general alignment with the aperture in the track, and a storage area is provided beneath the hole and the inclined playfield. Thus, the storage area stores rolling balls for operable engagement with the popper and subsequent propulsion through the hole and the aperture. A delivery track can also be positioned beneath the playing field for delivering the ball from a remote location to the storage area. In operation, a switch detects the presence of a ball in the storage area, and a microprocessor operates in response to a signal to actuate the ball popper, thereby causing a plunger to extend from the ball popper to propel the rolling ball to the next level of play.

The present invention provides significant advantages over other play features of pinball games. The dual-action trap door allows rolling balls to roll thereover to maintain the ball in play on the elevated track, and also allows the addition of another rolling ball on the track from below the inclined playfield. Moreover, the trap door acts as a guide in the open position to direct the ball onto the track. By placing the ball popper directly below the aperture, playing space is also conserved and the complexity of the interlevel delivery device is mimimized. The nearly instantaneous action of the ball popper also serves to rapidly propel the rolling ball onto the elevated track, thereby reducing "dead time" and facilitating the quick pace and interest in the game.

The present invention, together with further objects and advantages, will be best understood by reference to the following detailed description taken in conjunction with the accompanying drawings.

DETAILED DESCRIPTION OF THE PREFERRED EMBODIMENT

Figure 1:
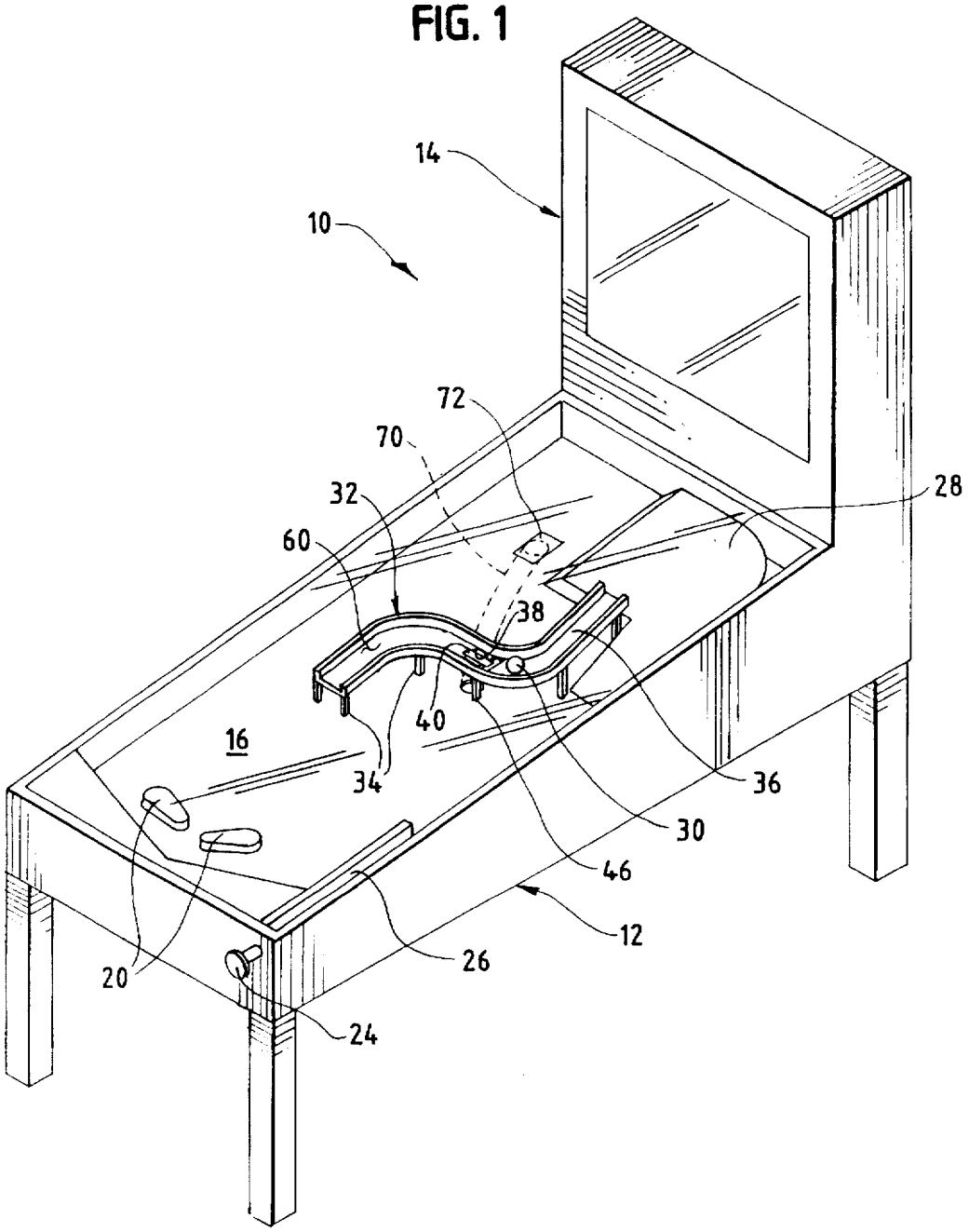
FIG. 1 is a perspective view of a pinball machine incorporating a preferred embodiment of the present invention.

While the present invention is susceptible of embodiment in various forms, there is shown in the drawings and will hereinafter be described a preferred embodiment of the invention with the understanding that the present disclosure is to be considered as setting forth an exemplification of the invention which is not intended to limit the invention to the specific embodiment illustrated.

Referring now to the drawings, wherein like reference numerals refer to like parts throughout the several views, there is shown in FIG. 1 a typical rolling ball game or pinball machine 10. The machine 10 includes a pinball cabinet 12 having a back box 14 for displaying the game score. The cabinet houses an inclined playfield 16 which includes thereon a number of playfield accessories such as flipper elements 20, and ramps, bumpers, target elements and the like (not shown). Game play is initiated by activating a plunger element 24 to shoot the game ball up alley 26 onto the playfield 16. A microprocessor is used to control play of the game and operation of the interlevel play feature of the present invention described herein.

As illustrated in FIG. 1, the game ball can proceed onto an elevated platform 28 positioned in the corner of the playfield 16. Once on the platform 28, a game ball or rolling ball 30 can proceed onto an elevated surface in the form of a track 32 mounted to the playfield 16. The track 32 can be any desired shape and curvature to direct the rolling ball 30 to a desired location. The track 32 is supported by support elements 34 above the main playfield 16 at a distance which allows a ball to roll beneath the track 32 and to activate other devices (not shown) which may be mounted on the main playfield 16. A floor 36 of the track 32 is also inclined with respect to the horizontal so that the game ball 30 rolls toward flipper elements 20 when the ball is on the track 32.

Figure 2:
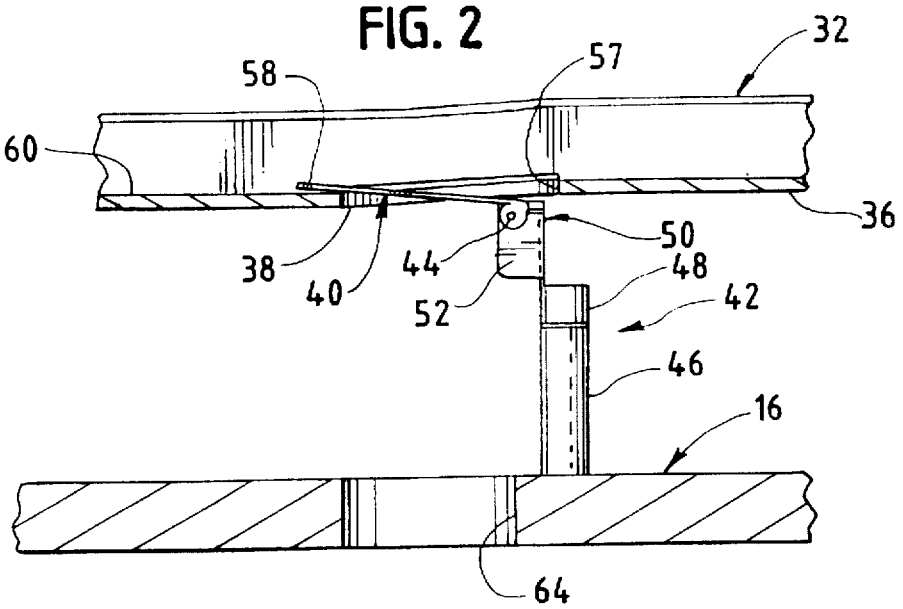
FIG. 2 is a partial section view of a trap door assembly mounted to an inclined playfield and showing a trap door in a closed position extending through an aperture in an elevated track.
Figure 4:
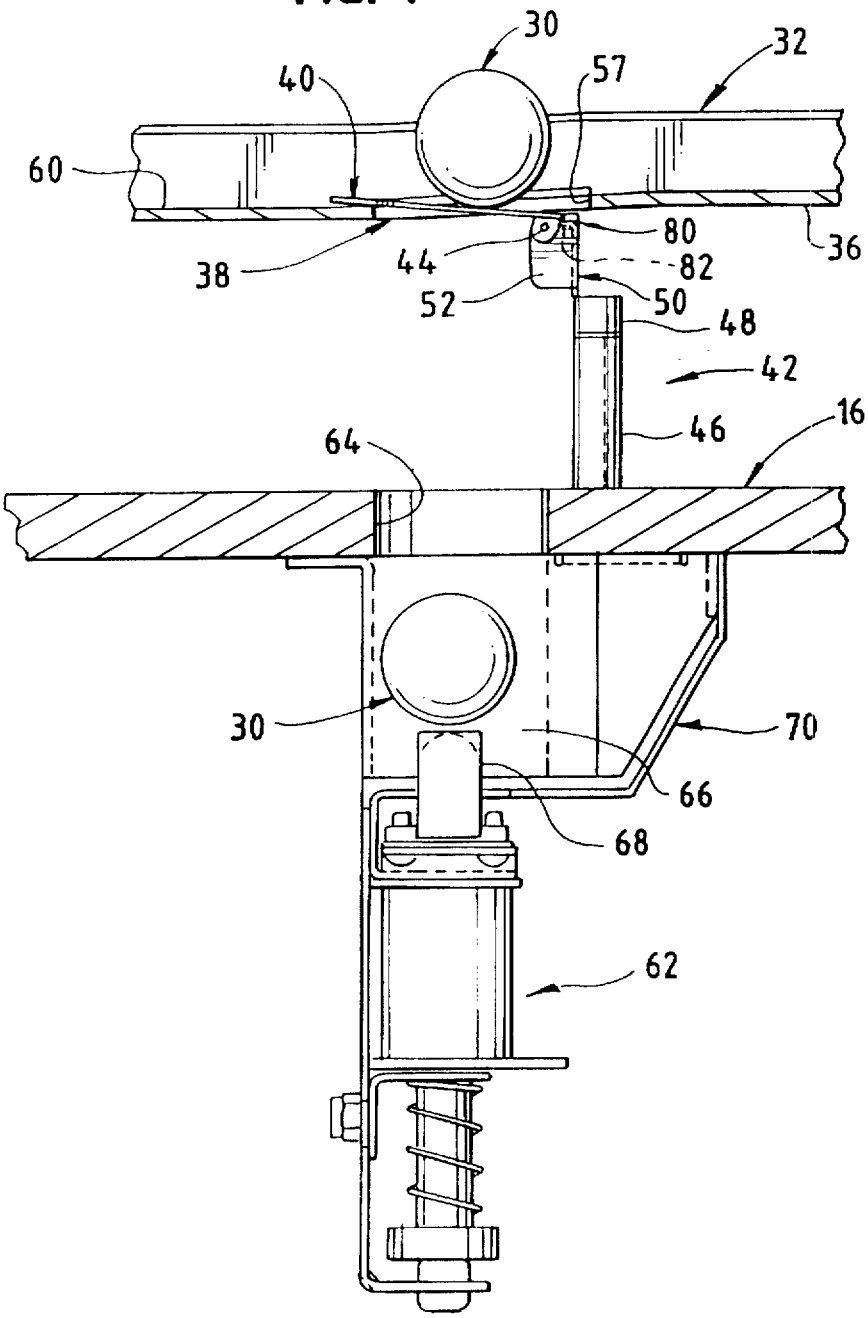
FIG. 4 is a partial section view showing a first game ball rolling over the closed trap door on the track, and a second game ball in a storage area in operable engagement with a ball popper below the inclined playfield.
Figure 5:
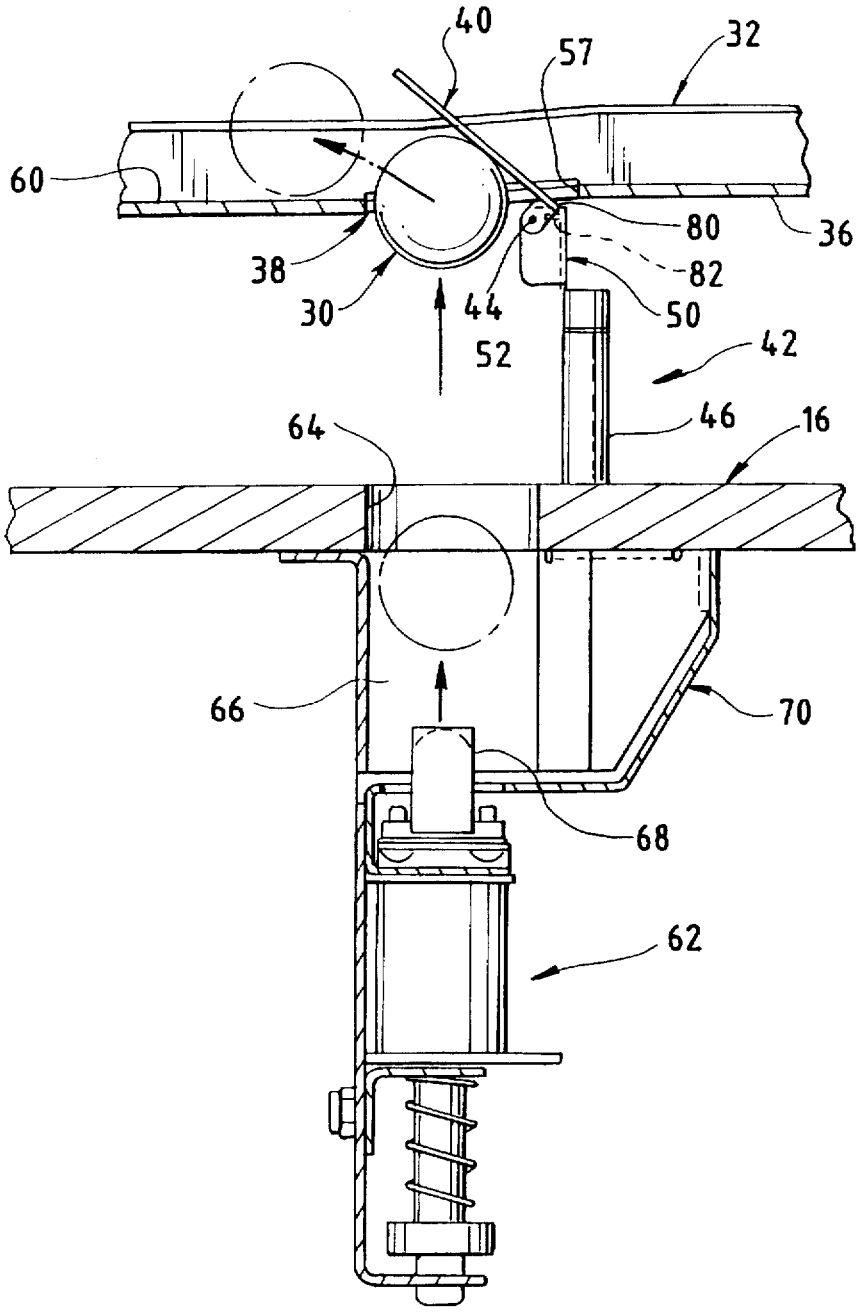
FIG. 5 is a partial section view showing the path of the second game ball as it is propelled against the trap door to place the trap door in an open position which guides the game ball onto the elevated track.

To provide for interlevel play in accordance with the present invention, an aperture 38 is formed in the floor 36 of the track 32. Preferably, the aperture 38 is configured as a rectangular cutout large enough for a game ball to fit therethrough. As shown in FIG. 2, a trap door 40 is provided for supporting the rolling ball 30 thereon and allowing another rolling ball to enter the aperture 38 from underneath the track 32. The trap door 40 is pivotable between a closed position (FIGS. 1–4) and an open position (FIG. 5). As shown in FIG. 2, the trap door 40 is hingedly attached to a support assembly 42 and is pivotable about a horizontal pivot axis 44. The support assembly 42 includes a pair of vertical legs 46 mounted to the playfield 16 and a top horizontal cross-bar 48 interconnecting the legs 46. A bracket 50 is attached to the cross-bar 48 and has a pair of vertical flanges or ears 52 extending outwardly therefrom. The trap door 40 is pivotally attached to the bracket ears 52 by a pivot rod 54 extending horizontally therethrough. A pair of end caps 56 are also disposed on the ends of the pivot rod 54 to secure it to the bracket 50.

Figure 3:
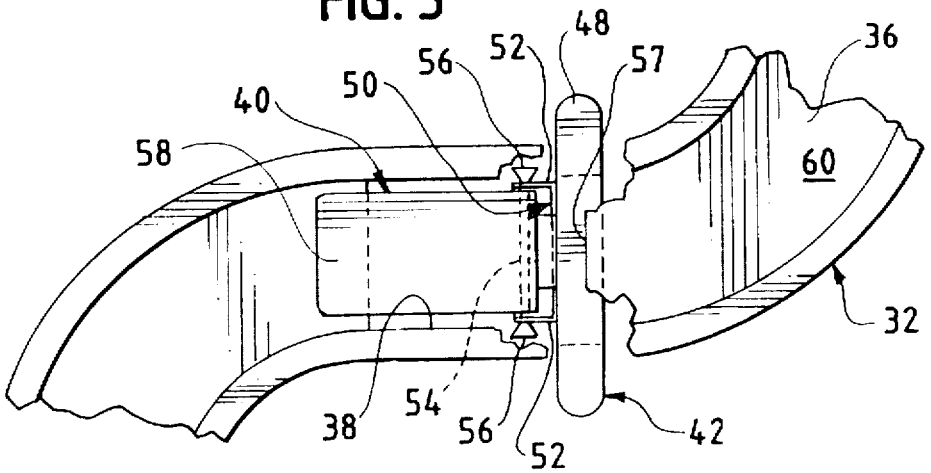
FIG. 3 is a top view of the trap door assembly and elevated track illustrated in FIG. 2.

Preferably, the entire support assembly 42 and the pivot axis 44 of the trap door 40 is positioned beneath the track 32. The pivot axis 44 is also positioned adjacent a rear edge 57 of the aperture 38. When the trap door 40 is in the closed position as shown in FIGS. 2 and 3, a terminal end portion 58 of the trap door 40 extends through the aperture 38 and rests against a top surface 60 of the track floor 36. Thus, when the trap door 40 is in the closed position, a substantially continuous support is provided for a rolling ball 30 to move thereover as shown in FIG. 4. In addition, the width of the trap door 40 is slightly less than the width of the aperture 38 to allow the trap door 40 to freely pivot upwardly within the aperture 38.

To propel a rolling ball through the aperture 38 and onto the track 32, a solenoid activated ball popper 62 is mounted beneath an outlet or eject hole 64 in the playfield 16 (FIG. 4). The ball popper 62 and hole 64 are in general alignment with the aperture 38 in the track 32. A storage area 66 is also provided for positioning the game ball for subsequent engagement with the ball popper 62 as shown in FIG. 4. The ball popper 62 is well-known in the art and its operation and construction will be readily apparent to those of ordinary skill. Generally, a rolling ball 30 is positioned so that when the ball popper is actuated, plunger 68 will extend upwardly to propel the ball through outlet hole 64. An optical switch (not shown) consisting of a light emitter and light detector (or other ball detector) is located in the storage area 66 adjacent the plunger 68 to send a signal to the game microprocessor indicating the presence or absence of a ball in the stored location.

As illustrated in FIGS. 1, 4 and 5, the storage area 66 is located at the end of an inclined delivery ramp 70 which is positioned underneath the playfield 16. The delivery ramp 70 conveys the rolling ball by gravity from an inlet 72 (FIG. 1) to the storage area 66 (FIG. 4). The number and location of inlets and delivery ramps can vary depending on the desired effect of the game.

Other mechanisms for ejecting the ball can be used if desired, and other storage devices can be employed for positioning the ball for engagement with the ball popper. For example, a centering plate can be mounted to the eject hole 64 which has a diameter which is less than the diameter of the game ball. Thus, the game ball comes to rest within the centering plate and at a precise location with respect to the ball popper 62. In this type of arrangement, the ball will enter the centering plate by rolling on top of the playfield 16, and will extend partially above the playfield when resting on the centering plate.

The operation of the present invention will be described with specific reference to FIGS. 1, 4 and 5. During the course of a game the player will be able to shoot or otherwise direct the ball in play onto the top of track 32. As illustrated in FIG. 1, this could occur when the ball rolls onto the track 32 from the platform 28. In such a situation, the trap door 40 will normally be in the closed position to allow the ball to roll over the trap door 40 and continue down the entire length of the track 32. At least one ball is also located in each storage area 66 underneath the playfield 16. If more than one ball is located in the storage area 66, a first ball will be located over the plunger 68 of ball popper 62, and the other ball(s) will be lined up behind the first ball. Also, during the course of play, a player will be able to shoot or otherwise direct the ball in play into the ball inlet 72 for delivery to the storage area 66.

At some time to be determined by the game rules, the microprocessor will actuate the ball popper 62 so that the plunger 68 ejects the ball through the eject hole 64 (FIG. 5). The ball will contact the trap door 40 and force it to pivot upwardly to the open position shown in FIG. 5. The momentum of the ball carries it onto the track where the ball begins moving by gravity. Thus, the ball is rapidly placed in play either by itself or with other balls elsewhere on the playfield. To limit the upward movement of the trap door 40, a stop member 80 is disposed on a rear edge of the trap door 40. Thus, the ball forces the trap door to pivot upwardly until the stop member 80 engages a horizontal tab member 82 extending from the bracket 50 on the support assembly 42. This causes the rolling ball to change direction when it is propelled through the aperture 38 in the track, and also guides the rolling ball onto the top surface of the track.

Thus, a dual-action trap-door is provided which allows rolling balls to roll thereover to maintain the ball in play on the elevated track, and also allows the rapid addition of another rolling ball on the track from below the inclined playfield. Moreover, the trap door acts as a guide in the open position to direct the ball onto the track.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. An apparatus for providing interlevel play for a pinball game comprising:

an inclined playfield an elevated surface mounted above the playfield for supporting a rolling ball thereon, said elevated surface having an aperture therein for receiving said rolling ball therethrough;

a trap door movable between a closed position, wherein said trap door supports the rolling ball thereon, and an open position, wherein the rolling ball may be ejected through the aperture and onto said elevated surface; and an ejecting mechanism adapted to eject said rolling ball from beneath the elevated surface, through the aperture, and onto the elevated surface.

2. The apparatus of claim 1 wherein the elevated surface is configured as a track for delivering the rolling ball to a desired location.

3. The apparatus of claim 2 wherein the track comprises a floor which is inclined to allow the rolling ball to move by gravity thereon.

4. The apparatus of claim 3 wherein the aperture comprises a rectangular cutout formed in the floor of the track.

5. The apparatus of claim 1 wherein the trap door is hingedly attached to a support member and is pivotable about a horizontal pivot axis.

6. The apparatus of claim 5 wherein said pivot axis is positioned beneath the elevated surface and a terminal end portion of the trap door is adapted to extend through the aperture and rest against a top portion of the elevated surface, thereby providing a substantially continuous support for the rolling ball to move thereover, and wherein the trap door is pivotable upwardly by contact with the rolling ball when said rolling ball is ejected from the ejecting mechanism.

7. The apparatus of claim 1 wherein the trap door is pivotable upwardly by contact with the rolling ball, said trap door having a stop member disposed thereon for limiting the upward movement of the trap door, thereby changing direction of the ejected rolling ball and guiding the rolling ball onto a top portion of the elevated surface.

8. The apparatus of claim 1 wherein the ejecting mechanism is positioned beneath the inclined playfield.

9. The apparatus of claim 8 further comprising a hole in the inclined play field in general alignment with the aperture in the elevated surface, and further comprising a storage area beneath said inclined playfield for storing said rolling ball for operable engagement with the ejecting mechanism and propulsion through the hole and the aperture.

10. The apparatus of claim 9 further comprising a ball delivery track positioned beneath the playing field for delivering the ball from a remote location to the storage area.

11. An apparatus for providing interlevel play for a pinball game comprising:

an inclined playfield;

an elevated track mounted above the playfield for supporting a rolling ball thereon, said track having an aperture therein for receiving the rolling ball therethrough;

a trap door pivotable about a horizontal axis between a closed position and an open position, said trap door adapted to support the rolling ball thereon in said closed position, and being pivotable upwardly to the open position by contact with the rolling ball, said trap door having a stop member disposed thereon for limiting the upward movement of the trap door, thereby changing direction of the ejected rolling ball and guiding the rolling ball onto a top portion of the track; and an ejecting mechanism adapted to eject said rolling ball from underneath the track, through the aperture, and onto a top surface of the track.

12. The apparatus of claim 2 wherein the track comprises a floor which is inclined to allow the rolling ball to move by gravity thereon.

13. The apparatus of claim 12 wherein the aperture comprises a rectangular cutout formed in the floor of the track.

14. The apparatus of claim 11 wherein said pivot axis is positioned beneath a floor of the track and a terminal end portion of the trap door is adapted to extend through the aperture and rest against a top surface of said floor, thereby providing a substantially continuous support for the rolling ball to move thereover, and wherein the trap door is pivotable upwardly by contact with the rolling ball when said rolling ball is ejected from the ejecting mechanism.

15. The apparatus of claim 11 wherein the ejecting mechanism is positioned beneath the inclined playfield.

16. The apparatus of claim 15 further comprising a hole in the inclined playfield, and a storage area beneath said inclined playfield for storing said rolling ball for operable engagement with the ejecting mechanism and propulsion through the hole and the aperture.

17. The apparatus of claim 16 further comprising a ball delivery track positioned beneath the playing field for delivering the ball from a remote location to the storage area.

18. The apparatus of claim 17 wherein the ejecting mechanism comprises a ball popper.

19. The apparatus of claim 18 further comprising a switch mounted to detect the presence of a ball in the storage area.

20. The apparatus of claim 19 further comprising a microprocessor operating in response to a signal to actuate said ball popper.

21. An apparatus for providing interlevel play for a pinball game comprising:

an inclined playfield;

an elevated track mounted above the playfield for supporting a rolling ball thereon, said track having a floor with an aperture therein for receiving the rolling ball therethrough;

a trap door having a horizontal pivot axis positioned beneath the floor of the track and a terminal end portion adapted to extend through the aperture and rest against a top surface of the floor, said trap door being pivotable between a closed position, wherein said trap door extending substantially the length of the aperture to support the rolling ball thereon, and an open position, wherein the trap door is pivoted upwardly by contact with the rolling ball, said trap door having a stop member disposed thereon for limiting the upward movement of the trap door, thereby changing direction of the ejected rolling ball and guiding the rolling ball onto a top portion of the track; and an ejecting mechanism adapted to eject said rolling ball from underneath the track, through the aperture, and onto a top surface of the track.

22. The apparatus of claim 21 wherein the ejection mechanism is positioned beneath the inclined playfield, and further comprising a hole in the inclined playfield for storing said rolling ball for operable engagement with the ejecting mechanism and propulsion through the hole and the aperture.

23. The apparatus of claim 22 further comprising a ball delivery track positioned beneath the playing field for delivering the ball from a remote location to the storage area.

24. The apparatus of claim 22 wherein the ejecting mechanism comprises a ball popper.

25. The apparatus of claim 24 further comprising a switch mounted to detect the presence of a ball in the storage area.

26. The apparatus of claim 25 further comprising a microprocessor operating in response to a signal to actuate said ball popper.

* * * * *